US005924317A

United States Patent [19]

Buck

[11] Patent Number: 5,924,317

[45] Date of Patent: Jul. 20, 1999

[54] RADIAL ROLLER HEAD

[75] Inventor: Torsten Buck, Hamburg, Germany

[73] Assignee: Wilhelm Fette GmbH, Schwarzenbek, Germany

[21] Appl. No.: 09/007,405

[22] Filed: Jan. 15, 1998

[30] Foreign Application Priority Data

Jan. 15, 1997 [DE] Germany ..... 197 01 049

[51] Int. Cl.[6] ..... B21H 3/04

[52] U.S. Cl. ..... 72/121; 72/104

[58] Field of Search ..... 72/104, 121

[56] References Cited

U.S. PATENT DOCUMENTS 3,352,139 11/1967 Cummings ..... 72/121
3,913,365 10/1975 Kruse ..... 72/104

FOREIGN PATENT DOCUMENTS 42 36 085 A 1 10/1992 Germany ..... B21H 3/04

*Primary Examiner*—Lowell A. Larson
*Attorney, Agent, or Firm*—Faegre & Benson LLP

[57] ABSTRACT

The invention discloses a radial roller head with rollers arranged in a holder over the same angular distances and distributed at axial distances about the rolling axis. The roller surfaces of the rollers have over the circumference a spiral-shaped increasing course opposed to their rotational direction. There is a toothed gearing coupling the rollers to one another, a locking for the rollers, which after each complete roller revolution automatically latches and can be released before each rolling procedure, a stop which can be brought into engagement with the subject on the introduction movement of a subject between the rollers, and which releases the locking; and a drive means which after the releasing of the locking rotates the rollers until the bearing of the roller surface on the subject in order subsequently by way of friction to be further rotated with this subject. The roller head, with respect to an axially fixed bearing component arranged on the side opposite to the roller in the roller direction, is axially displaceably mounted against a pretension spring, and between the bearing component and the locking in the roller, a release device in the form of a gear arrangement is provided by way of which the locking is only released when the roller head is moved about an operating stroke onto the bearing component by the subject abutting against the stop on the introduction movement.

7 Claims, 1 Drawing Sheet

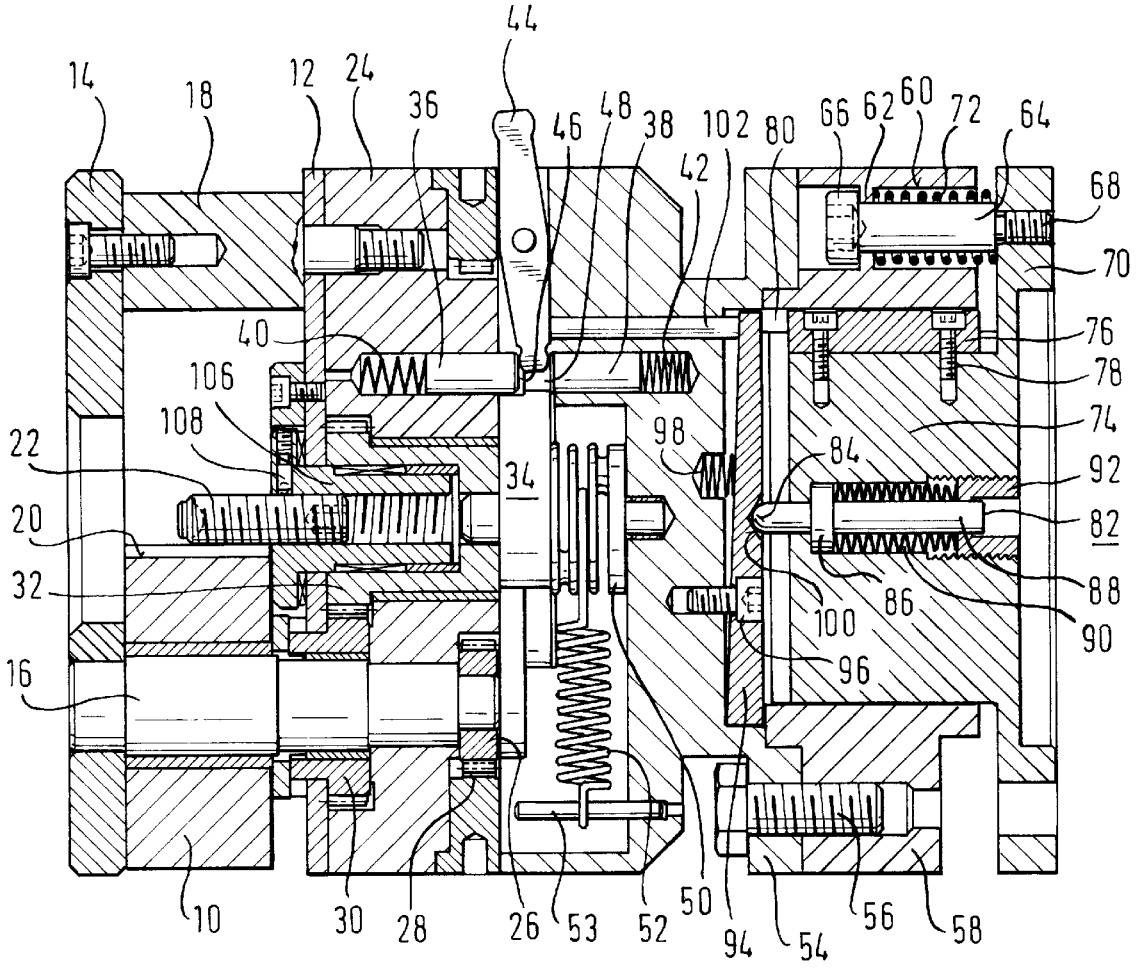
44
14
18
12
24
36
46
48
38
102
80
66
62
60
72
64
68
70
42
40
76
78
106
108
74
22
98
84
92
34
20
82
32
88
86
100
90
16
96
10
30
28
26
53
52
50
94
54
56
58

RADIAL ROLLER HEAD

BACKGROUND OF THE INVENTION

The invention relates to a radial roller head according to the earlier part of patent claim 1.

From DE 42 36 085 there is known a radial roller head with rollers arranged in a holder distributed at equal angular distances and at axial distances about the rolling axis. The roller surfaces have a spiral-shaped increasing course over the circumference opposed to their rotational direction. The rollers are coupled to a toothed gearing and a locking latches automatically after each complete roller revolution. Before the rolling procedure the locking is released, this being by the subject which is to be formed with the rollers. With the known radial roller head there is provided a stop which limits the introduction movement of the subject between the rollers, which is coupled to the locking of the rollers and which is displaceable in the direction of the rolling axis about an operating stroke against the action o)f compression springs. The locking is released on bearing of the subject due to its movement about the operating stroke.

With the known radial roller head there is the danger that during the releasing procedure or also thereafter a relative movement takes place between the subject and rollers if the subject has not achieved its stationary situation. This procedure naturally inhibits the forming procedure.

BRIEF SUMMARY OF THE INVENTION

It is the object of the invention to provide a radial roller head on whose releasing procedure a relative movement between the rollers and the subjects is avoided.

This object is achieved by the features of patent claim 1.

With the radial roller head according to the invention this is axially displaceably mounted with respect to an axially fixed component. A displacement of the roller head is effected against a pretensioned spring which presses the roller head into a position situated as far as possible from the bearing component, this position being limited by appropriate stops. Between the bearing component and the roller head there operates a releasing device in the form of some gear arrangement which releases the locking when the roller head is moved towards the bearing component.

On an introduction movement the subject hits the stop which for its part drives the roller head and moves it against the bearing component. This movement leads to the releasing of the locking of the roller head on reaching the releasing point. The locking may be conventional. According to one embodiment of the invention the releasing device contains a lever which is arranged between the bearing component and the roller head and acts on a pressure pin which for its part cooperates with the locking.

The maximum displacement distance of the roller head is, according to one embodiment of the invention, with respect to the bearing component larger than is required for releasing the locking. This contributes to the security of the process.

Particularly advantageous is the combination of the invention with a radial roller head which according to DE 42 36 085 comprises a blocking cam coupled to the toothed gearing, with two cam sections to which in each case there is allocated a bar biased with a spring in the blocking direction, these being selectively movable out of the blocking position by a blocking lever. The blocking lever may comprise a manually operable handling section. The blocking position of the bar biased with the weaker spring is arranged before the blocking position of the bar biased with the stronger spring in the stop direction, and on one roller revolution the cam sections undergo one cam revolution. The pressure pin which is operated between the roller head and the bearing component by the lever is led to the blocking lever in order to pivot this on an operating stroke against the bar biased by the stronger compression spring and to press this bar out of its blocking position.

With another embodiment of the invention in the bearing component there is mounted an axially movable counter bearing which is pretensioned by a spring in the direction of the lever, wherein the spring is designed stronger than the pretension spring of the bearing component. Preferably the counter bearing is formed by a pin which is pretensioned by a disk spring assembly. The pin may engage with a rounded end into a corresponding recess of the lever. The yielding counter bearing has the advantage that by way of this there is created a safety measure on axial movement of the subject beyond the releasing point.

In order to prevent friction between the subject and the stop of the radial roller head, this according to one embodiment of the invention is rotatably mounted. For this purpose a stop pin is accommodated in a sleeve which for its part is rotatably mounted. The stop pin may comprise an outer thread which cooperates with the inner thread of the sleeve in order to change the axial position of the stop pin.

As can be recognized, the subject and the radial roller head also have the same movement direction after the subject lilts the stop. A relative movement between the subject and the roller is therefore ruled out. The releasing device according to the invention may be mounted on conventional standard radial roller heads. Only an additional flange is to be provided as a bearing component. With newly made radial roller heads the bearing component may be integrated into the head.

BRIEF DESCRIPTION OF THE DRAWINGS

The invention is hereinafter explained in more detail by way of one drawing.

The single FIGURE shows a section through a radial roller head according to the invention.

DETAILED DESCRIPTION OF THE INVENTION

The design shown corresponds to conventional designs with respect to the toothed gearing, the locking for the rollers and the drive means for rotating the rollers in the installation onto the subject.

The radial roller head has three profiled rollers, of which one is indicated at 10. They are arranged over the periphery distributed between two bearing plates 12 and 14 for axes 16. The bearing plates 12, 14 are kept at a distance from one another by distance bolts 18. Each of the rollers has a flattening 20 which in the shown rest position in each case face the rolling axis. Proceeding from the middle of the flattening 20 there extends over the periphery over 180° a section of the roller surfaces with increasing diameter with a spriral-shaped course. To this there connects a roller surface concentric to the rolling axis over an angle of 90°. The remaining angle of 90° is used for a reducing part of the roller surface.

Each axis of the roller 10 comprises an eccentric section which is rotatably mounted on a gear plate 24 of the roller head. At the rear end there is seated on the axes 16 in each case a gearwheel 26 which meshes with a gear rim 28. A rotation of the gear rim 28 leads to a rotation of the gearwheels 26 which are rigidly seated on the axes 16, so that with the help of this mechanism the reference diameter of the rollers 10 may be slightly decreased or increased.

On the axes 16 in each case sits a gearwheel 30 which meshes with the intermediate gearwheel 32. A blocking cam 34 is rigidly attached to the intermediate gearwheel 32 and cooperates with two blocking pins 26, 38. The pins 36, 38 are in each case pressed by a spring 40, 42 in the blocking direction wherein the spring 40 is the stronger one.

Between the pins 36, 38 there engages a blocking lever 44 which with the other end projects from the radial roller head and may for example be grasped by the hand. In the shown blocked position the pin 36 is located in the blocking position, in which it engages into the rotational path of the blocking cam 34 in the region of the cam section 46. Allocated to the pin 38 is a cam section 48 of the cam 34 which protrudes somewhat in the stop direction.

The blocking cam is connected to a disk arrangement 50 in a rotationally rigid manner onto which tension springs at 120° distances engage, of which one is indicated at 52. At the other end the springs 52 are fastened in a housing 54 via a pin 53, the housing being rigidly connected to the gear plate 24. They exert a moment on the blocking cam 34, which seeks to rotate this cam out of the blocking position.

A pivoting of the blocking lever 44 out of the rest position shown into an operating position has the effect that the pin 36 is pressed out of the blocking position and the blocking cam 34 is rotated by its tension springs 52. The gear consisting of the intermediate gearwheel 32 and the gearwheels 30 transmits the rotational movement onto the rollers 10, which with their increasing roller surface come to bear on the subject. After a frictional fitting bearing on the subject they are further rotated by this, still before the drive springs reach their dead center beyond which they may effect a further rotation of the blocking cam 34. On further rotation of the rollers 10 relative to the subject, the tension springs 52 are again tensioned. For this they engage with hooklike ends into the disk arrangement 50.

On rotation of the blocking earn 34 the pin 38 is pressed by its spring 42 in its blocking position in the rotational region of the cam section 48. As a result of this the cam section 48 comes to stop after approximately one cam rotation and prevents a further rotation of the rollers 10. In this position the rollers are turned with their flattenings 20 to the subject and the subject (not shown) may be moved out of the roller intermediate space. If the blocking lever 44 is released, the stronger spring 40 presses the pin 36 back into its blocking position, wherein the pin 38 is pressed out of its blocking position against the weaker spring 42. Since the cam section 46 is arranged somewhat before cam section 48 in the direction of the stop, at the same time, the blocking cam 34 is rotated further about a small angle. By way of this and by way of the overlapping of the blocking positions of the pins 36, 38, it is ensured that the rolling process on release of the blocking lever 44 is not released again.

Subsequently the releasing automatics of the radial roller head is described. The cam 34 is rotatably mounted with a shaft journal in the spring housing 54, which e.g. accommodates the pin 38 and the spring 42. By way of fastening screws 56 an annular component 58 is connected to the right side of the housing 54 comprising bores 60 parallel to the axis at circumferential distances in which with the help of a radially projecting shoulder 62 there are formed bore sections. The bores 60 accommodate a bolt 64 which with the head 66 in the left end, comes to rest against the shoulder 62. A section 68 of the bolt 64, which smaller in diameter, is screwed into a threaded bore of a bearing component 70 in the form of a flange on the right side of the housing 54. On the shank of the bolt 64 there is arranged a helical spring 72 which with the left end is supported on the shoulder 62 and with the right end on the bearing component 70. Between the head 66 of the screw bolt 64 and the housing 54 there is left a distance.

On a middle axial shoulder 74 of the bearing component 70 at circumferential distances, feather keys 76 are mounted by way of screws 78. They engage into longitudinal grooves 80 on the inner side of the annular component 58. With this it can be recognized that the whole radial roller head can be displaced relative to and towards the bearing component 70 until the feather keys 76 abut against the bearing component 70. This movement is effected against the pressure of the helical springs 72. The feather keys 76 and the grooves 80 form an appropriate guide which however prevents a rotation of the parts to one another.

A counter bearing pin 82 is mounted in the middle in the axial shoulder 74 and with a left section 84 rounded on the free end, protrudes beyond the shoulder 74. A radial collar 86 of the pin 82 at the same time lays against the left end of the bore section in which it is accommodated. The right section 88 of the pin 82 extends through a disk spring assembly 90 into a nut 92 which is screwed into a threaded bore of the shoulder 74.

In a recess of the housing 54 there is arranged a lever 94 which is limited in its pivoting towards the right by a threaded bolt 9(,. The lever 94 may be pivoted against a spring 98 about a small angle towards the left out of the position shown in the figure, this spring being seated in an appropriate bore in the housing 54. The lever 94 has a conical recess 100 into which the section 84 with the rounded end engages. In the upper region in a bore parallel to the axis a pressure pin 102 is movingly mounted which with the one end rests on the blocking lever 44 and with the other end on the upper region of the lever 94.

In the plate 12 and in a bore of the middle gearwheel 32, a sleeve 106 is rotatably mounted. It accommodates in a threaded bore a stop pin 22 whose length protruding out of the sleeve 106 may be changed by twisting. In the respective position this pin may be held fast by a fastening pin 108.

If on operation of the radial roller head, the subject which is not shown comes into contact with the stop pin 22, the relative rotation between the subject and the radial roller head may be taken up by rotating the stop pin 22 with the sleeve 106. On further axial movement of the subject via the stop pin 22, the whole radial roller head is displaced towards the right against the springs 72. With this movement the counter bearing pin 82 remains unchanged in its position, since the disk spring assembly 90 is designed markedly stronger than the springs 72. In this way the lever 94 pivots anticlockwise and presses the pressure pin 102 to the left against the blocking lever 44 which is rotated in the clockwise direction. In this manner the releasing of the locking described further above takes place in which the pin 36 is moved to the left. The tension springs 52 rotate the locking cam 34 and the middle gearwheel 32 which drives the gearwheels 30 so that the rollers 10 engage with the subject.

If the relative movement between the subject and the radial roller head on releasing of the locking is not yet finished, the disk, spring assembly 90 may yield and thus prevent damage to the roller head.

I claim:

1. A radial roller head with rollers arranged in a holder over the same angular distances and distributed at axial distances about the rolling axis, the roller surfaces of the rollers having over the circumference a spiral-shaped increasing course opposed to their rotational direction, with a toothed gearing coupling the rollers to one another, with a locking for the rollers, which after each complete roller revolution automatically latches and can be released before each rolling procedure, with a stop which can be brought into engagement with the subject on the introduction movement of a subject between the rollers, and which releases the locking, and with a drive means which after the releasing of the locking rotates the rollers until the bearing of the roller surface on the subject in order subsequently by way of friction to be further rotated with this subject, wherein the roller head, with respect to an axially fixed bearing component arranged on the side opposite to the roller in the rolling direction, is axially displaccably mounted against a pretension spring, and wherein between the bearing component and the locking in the roller, a release device in the form of a gear arrangement is provided by way of which the locking is only released when the roller head is moved about an operating stroke onto the bearing component by the subject abutting against the stop on the introduction movement.

2. A radial roller head according to claim 1, wherein the release device comprises a lever arranged between the roller head and the bearing component, and which acts on a pressure pin releasing the locking.

3. A radial roller head according to claim 2, in which the toothed gearing for locking the roller comprises a blocking cam with two cam sections to which in each case there is allocated a pin biased in the blocking direction by a compression spring, which in each case arc selectively movable out of the blocking position by way of a blocking lever, wherein the compression springs have differing spring strengths and the blocking position of the pin biased by the weaker compression spring is arranged before the blocking position of the pin biased by the stronger compression spring in the direction of the stop, and the cam sections with one roller revolution undergo one cam revolution, wherein the pressure pin is led to the blocking lever in order to pivot this lever, on an operating stroke of the roller head with respect to the bearing component, against the pin biased by the stronger compression spring and to press this pin out of its blocking position.

4. A radial roller head according to claim 2, or 3, wherein in the bearing component an axially movable counter bearing is mounted which is pretensioned in the direction of the lever by a spring and this spring is designed stronger than the pretension spring of the bearing component.

5. A radial roller head according to claim 1, wherein the maximum displacing distance of the roller head with respect to the bearing component is larger than is required for releasing the locking.

6. A radial roller head according to claim 4, wherein the counter bearing is formed by a pin and the spring is a disk spring assembly.

7. A radial roller head according to claim 1, wherein the stop is formed as a stop pin which is accommodated in a sleeve rotatably mounted about the rolling axis and the stop pin comprises an outer thread for the purpose of screwing into an inner thread of the sleeve.

* * * * *